US012065291B2

(12) United States Patent
Lee

(10) Patent No.: US 12,065,291 B2
(45) Date of Patent: Aug. 20, 2024

(54) ENGAGING STRUCTURE OF A CONTAINER AND ITS COVER

(71) Applicant: Chen-Hsuan Lee, Taichung (TW)

(72) Inventor: Chen-Hsuan Lee, Taichung (TW)

( * ) Notice: Subject to any disclaimer, the term of this patent is extended or adjusted under 35 U.S.C. 154(b) by 327 days.

(21) Appl. No.: 17/706,570

(22) Filed: Mar. 28, 2022

(65) Prior Publication Data

US 2022/0363449 A1 Nov. 17, 2022

(30) Foreign Application Priority Data

May 13, 2021 (TW) ..... 110117322

(51) Int. Cl.
*B65D 45/20* (2006.01)
*B65D 43/02* (2006.01)

(52) U.S. Cl.
CPC ..... *B65D 45/20* (2013.01); *B65D 43/0208* (2013.01); *B65D 2543/00092* (2013.01); *B65D 2543/0049* (2013.01); *B65D 2543/00537* (2013.01); *B65D 2543/00555* (2013.01)

(58) Field of Classification Search
CPC ..... B65D 45/20; B65D 2543/00092; B65D 45/22; B65D 2251/1058; B65D 2251/1016; B65D 45/16; B65D 45/18
See application file for complete search history.

(56) References Cited

U.S. PATENT DOCUMENTS 3,767,110 A * 10/1973 Congleton ..... B65D 43/162 220/4.23
4,986,438 A * 1/1991 Borst ..... B65D 45/20 229/406
2020/0377265 A1* 12/2020 Yu ..... B65D 43/0212
2021/0053728 A1* 2/2021 Wang ..... B65D 51/242

* cited by examiner

*Primary Examiner* — Jeffrey R Allen

(57) ABSTRACT

An engaging structure for a container and its cover has a containing body and a corresponding covering member. The upper opening of the containing body has an outer lip edge, the opposing positions of the outer lip edge is provided with at least two the engaging portions. The outer edge of the engaging portion has with a movable buckle, the outer periphery of the covering member is provided with a covering lip covering the outer lip edge of the containing body, and the opposing positions of the periphery of the covering lip has at least two the locking portions corresponding to the engaging portion of the containing body. A locking protrusion is disposed on the locking portion, locking portion of the covering member is corresponding to each engaging portion of the containing body. By flipping the movable buckle, each the engaging curve can be fastened tightly to each locking protrusions.

7 Claims, 7 Drawing Sheets

ENGAGING STRUCTURE OF A CONTAINER AND ITS COVER

BACKGROUND OF INVENTION

Field of Invention

The present invention relates to a container structure, and more particularly to an engaging structure of a container and its cover.

Description of the Related Art

Mostly, the traditional plastic lunch box, including the box cover and the containing body, mainly uses the containing body to contain food, and then seals through the box cover. The box cover usually includes a top and side portion extending from a top outer edge toward down, thereby covering the periphery of the upper periphery of the containing body by the side portion of the box cover, and then securing the box cover on the containing body to seal the containing body.

However, the traditional box cover only covers the periphery of the containing body at the side edges. Although the inner wall of the sides of the box cover is provided with an engaging rib to be fastened and secured with the periphery of the box cover, when the containing body or the box cover is deformed by extrusion deformation, the side of the box cover might be deformed, so that the engaging ribs cannot be firmly snapped on the periphery of the containing body, which results in the box cover separates from the containing body and leads to the contents of the box are poured out and overflowed. In addition, the engaging rib of the box cover is snapped around the containing body, so whether to cover or uncover the containing body with the box cover, it takes a lot of time to buckle or remove the engaging ribs one by one, which makes the assembly and disassembly of the containing body and the covering member more troublesome and lacks practicability.

Therefore, it is desirable to provide an engaging structure of a container and its cover to mitigate and/or obviate the aforementioned problems.

SUMMARY OF THE INVENTION

An objective of present invention is to provide an engaging structure of a container and its cover, which is capable of improving the above-mention problems.

In order to achieve the above mentioned objective, an engaging structure for a container and its cover has a containing body and a corresponding covering member.

The containing body has an outer lip edge at an opening of the containing body, the outer lip edge has at least two engaging portions at two opposite positions, and each engaging portion has an engaging protrusion at a central position and two engaging recesses respectively on opposite sides of the engaging protrusion. Each engaging portion further has a movable buckle with an engaging curve at an outer edge, and the engaging curve further has an engaging groove with two contact sides facing one of the engaging protrusions and an engaging ring extending from a top end of the engaging curve and parallel to the engaging groove. The covering member has a covering lip covering the outer lip edge of the containing body, and the covering lip has at least two locking portions correspondingly covering and positioning the engaging portions of the containing body. Each locking portion has a locking protrusion with two opposing positioning grooves, the locking protrusion is hollow and correspondingly capable of covering one of the engaging protrusions, and the two positioning grooves interlock with the two engaging recesses. The locking protrusion further has a securing portion extending from a top and a slot defined between the securing portion and the covering lip.

Other objects, advantages, and novel features of invention will become more apparent from the following detailed description when taken in conjunction with the accompanying drawings.

DETAILED DESCRIPTION OF THE PREFERRED EMBODIMENT

Figure 1:
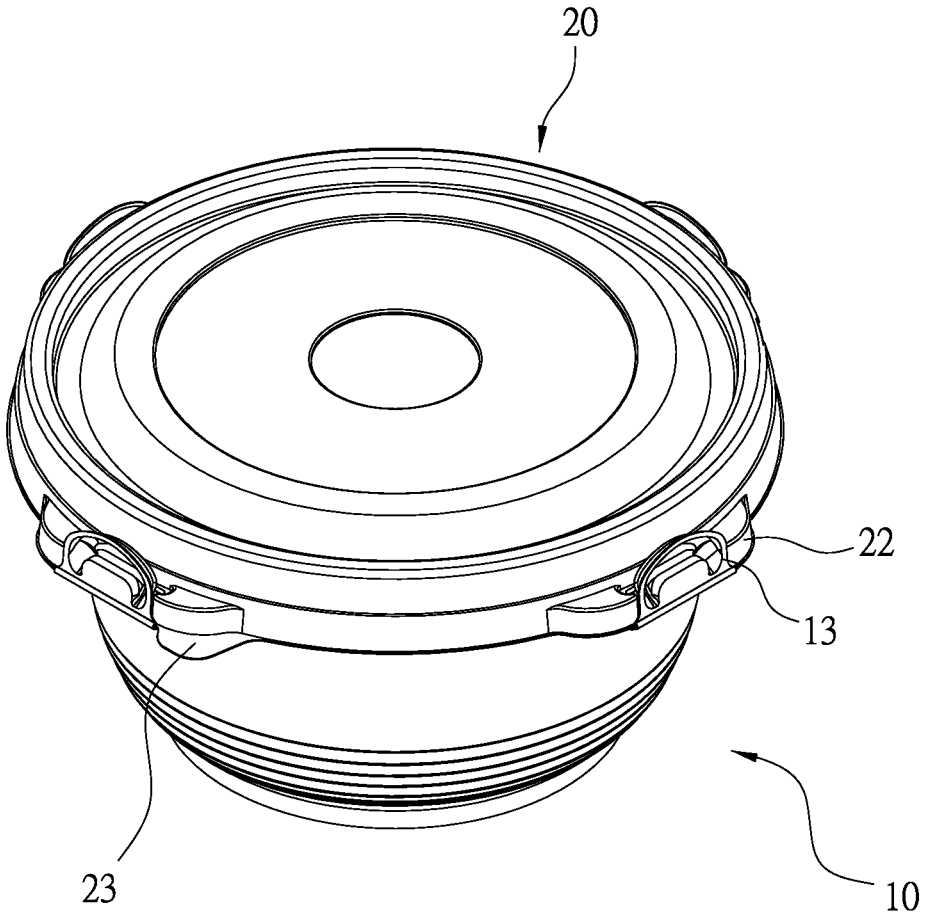
FIG. 1 is a perspective view of the engagement of the containing body and the covering member of a preferred embodiment according to the present invention.
Figure 2:
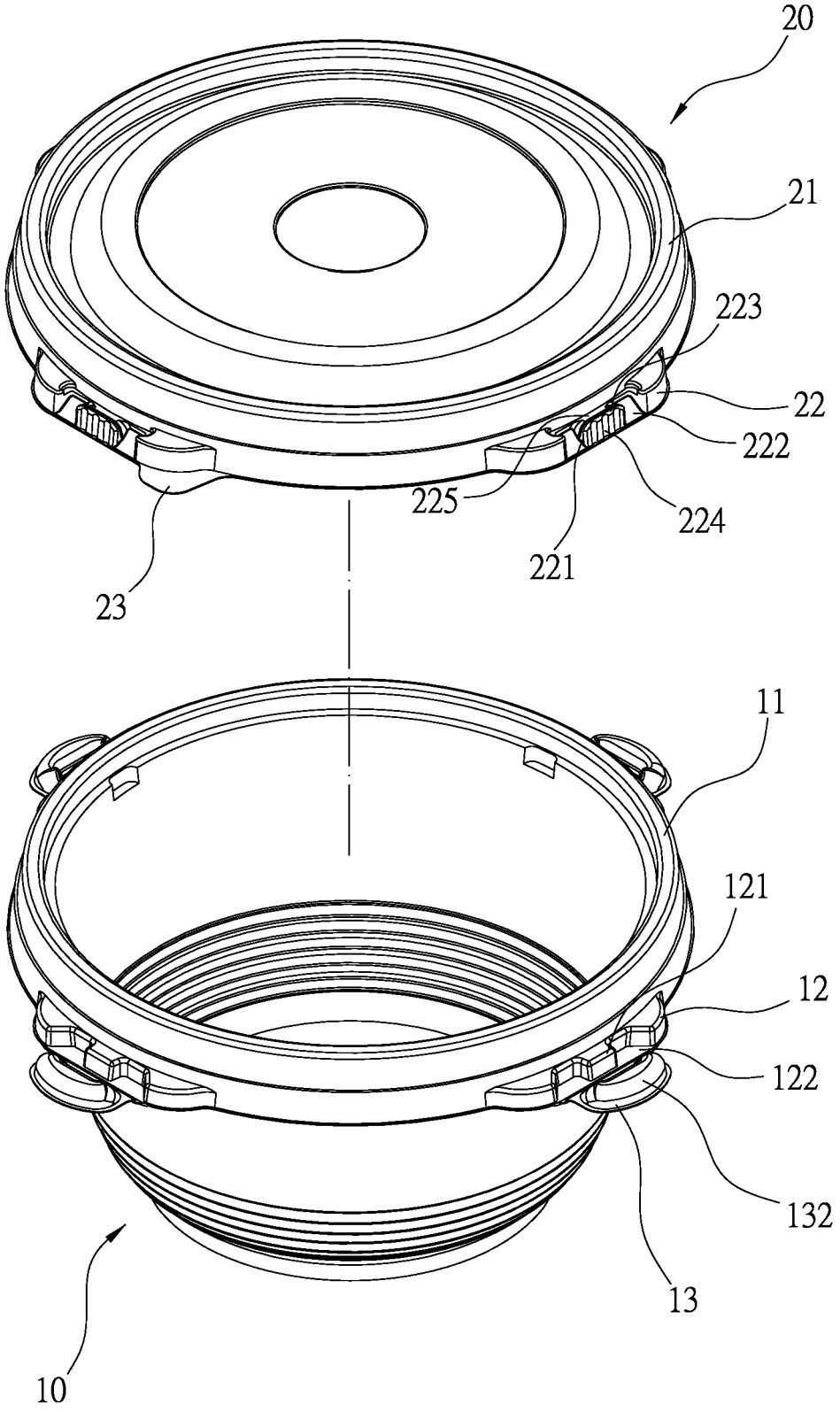
FIG. 2 is a perspective view of the disengagement of the containing body and the covering member of the preferred embodiment according to the present invention.
Figure 3:
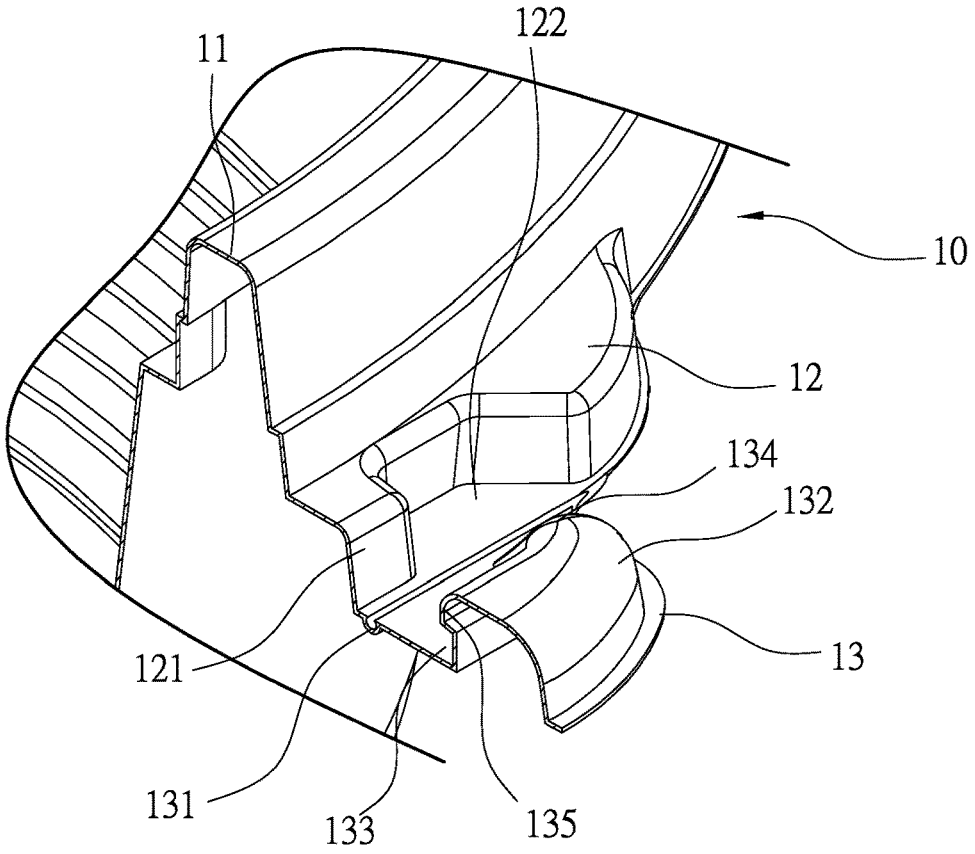
FIG. 3 is a partial cross-sectional perspective view of the containing body of the preferred embodiment according to the present invention.
Figure 4:
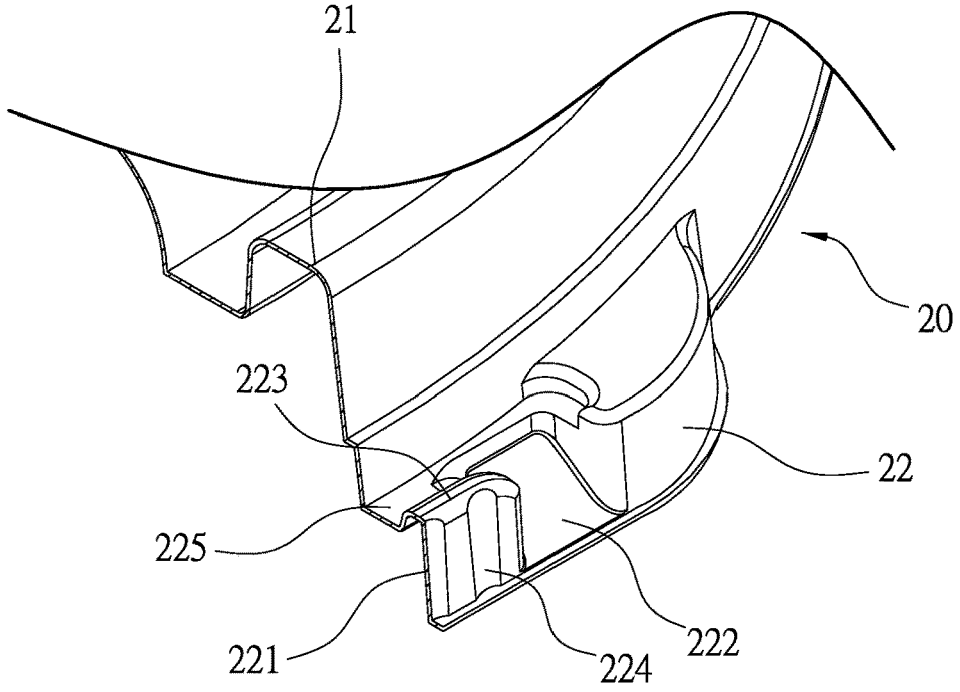
FIG. 4 is a partial cross-sectional perspective view of the covering member of the preferred embodiment according to the present invention.

First, please refer to FIG. 1 to FIG. 4. An engaging structure for a container and its cover comprises a containing body 10 and a covering member 20. The containing body 10 has an outer lip edge 11 at its opening, and the outer lip edge 11 further has four engaging portions 12 arranged in a cross pattern. Each engaging portion 12 has an engaging protrusion 121 at a central position and two engaging recesses 122 respectively on opposite sides of the engaging protrusion 121. Each engaging portion 12 further comprises a movable buckle 13, and a flexible portion 131 is disposed between the movable buckle 13 and the engaging portion 12 which allows the movable buckle 13 to be bent towards the outer lip edge 11. Moreover, the movable buckle 13 has an engaging curve 132 at an outer edge with an incline surface expand from top to bottom, an engaging groove 133 with two contact sides 134 facing one of the engaging protrusions 121, and an engaging ring 135 extending from a top end of the engaging curve 132 and parallel to the engaging groove 133. The covering member 20 has a covering lip 21 covering the outer lip edge 11 of the containing body 10. The covering lip 21 has four locking portions 22 correspondingly covering and positioning the engaging portions 12 of the containing body 10. Each locking portion 22 has a locking protrusion 221 with two opposing positioning grooves 222 respectively having two incline surfaces at two opposing sides. The locking protrusion 221 is hollow and correspondingly capable of covering one of the engaging protrusions 121, and the two positioning grooves 222 interlock with the two engaging recesses 122. The locking protrusion 221 further comprising a securing portion 223 extending from a top, each locking protrusion 221 and each securing portion 223 respectively have a plurality of reinforcement structures 224, and a slot 225 is defined between the securing portion 223 and the covering lip 21. Furthermore, the covering lip 21 of the covering member 20 has a flappable wing 23.

Figure 5:
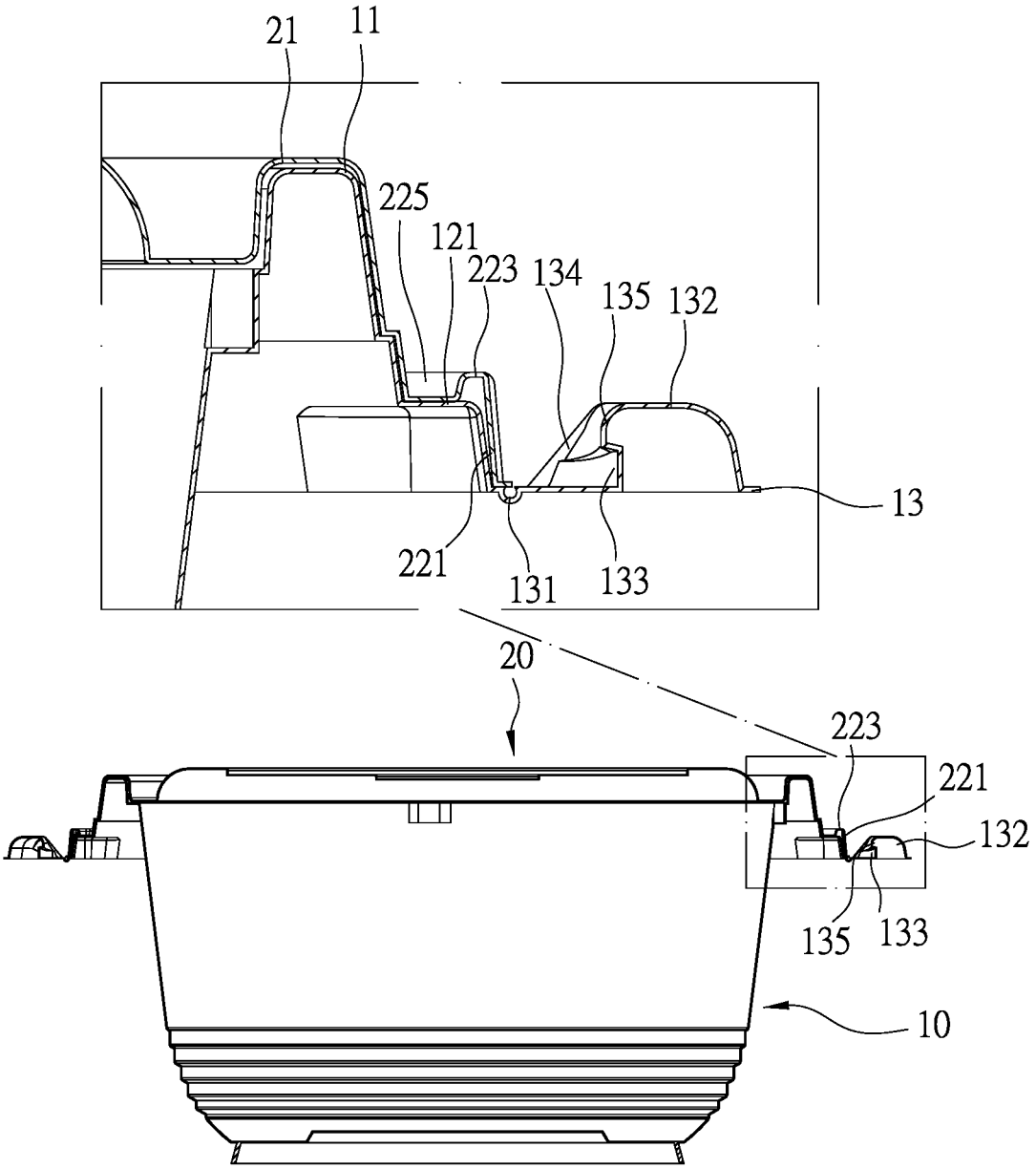
FIG. 5 is a cross-sectional view and a partial enlarged view of the covering member covering the opening of the containing body of preferred embodiment according to the present invention.
Figure 6:
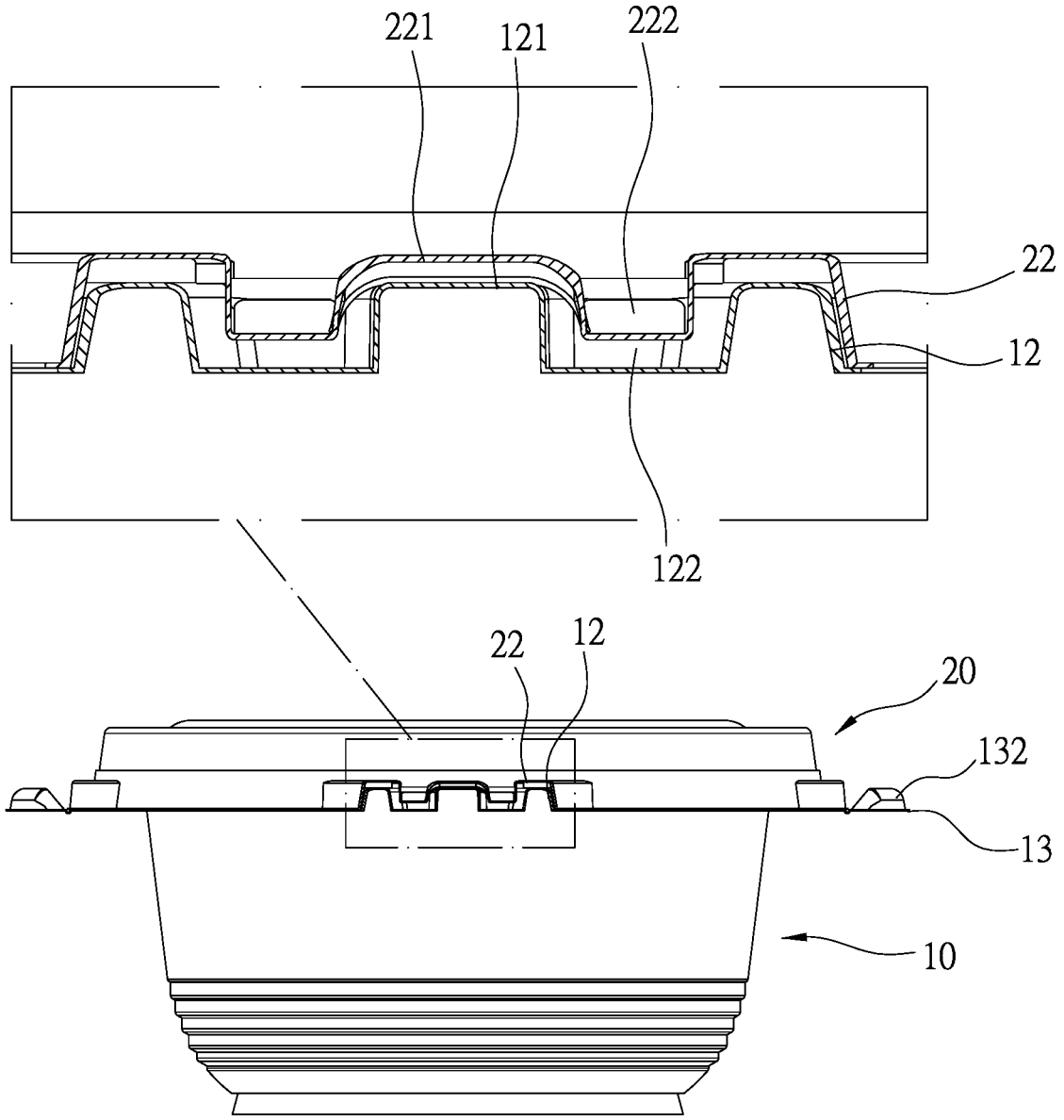
FIG. 6 is another perspective cross-sectional view and a partial enlarged schematic view of the covering member covering the opening of the containing body of the preferred embodiment according to the present invention.
Figure 7:
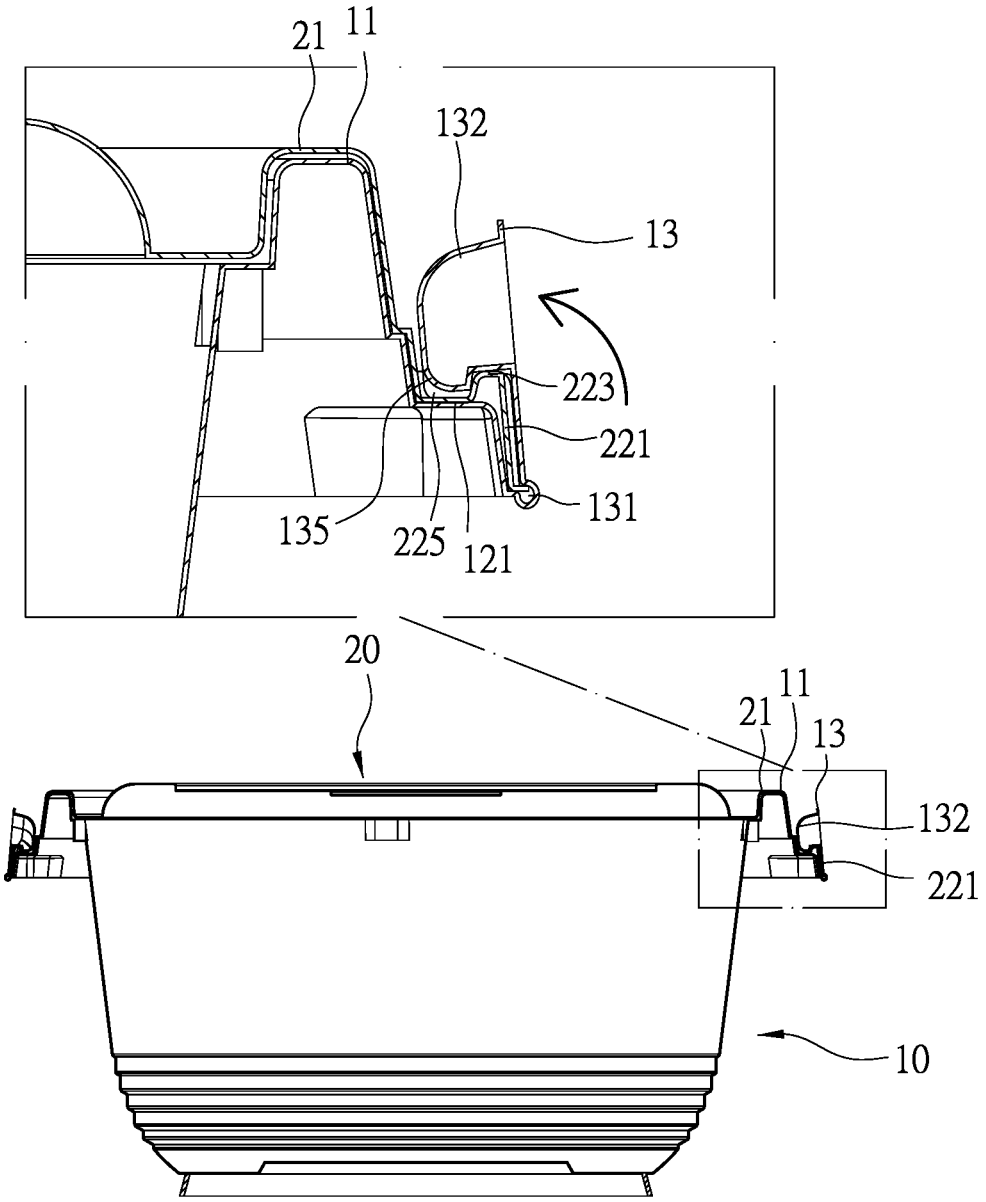
FIG. 7 is another perspective cross-sectional view and a partial enlarged schematic view of the covering member covering the opening of the containing body of the preferred embodiment according to the present invention.
Figure 8:
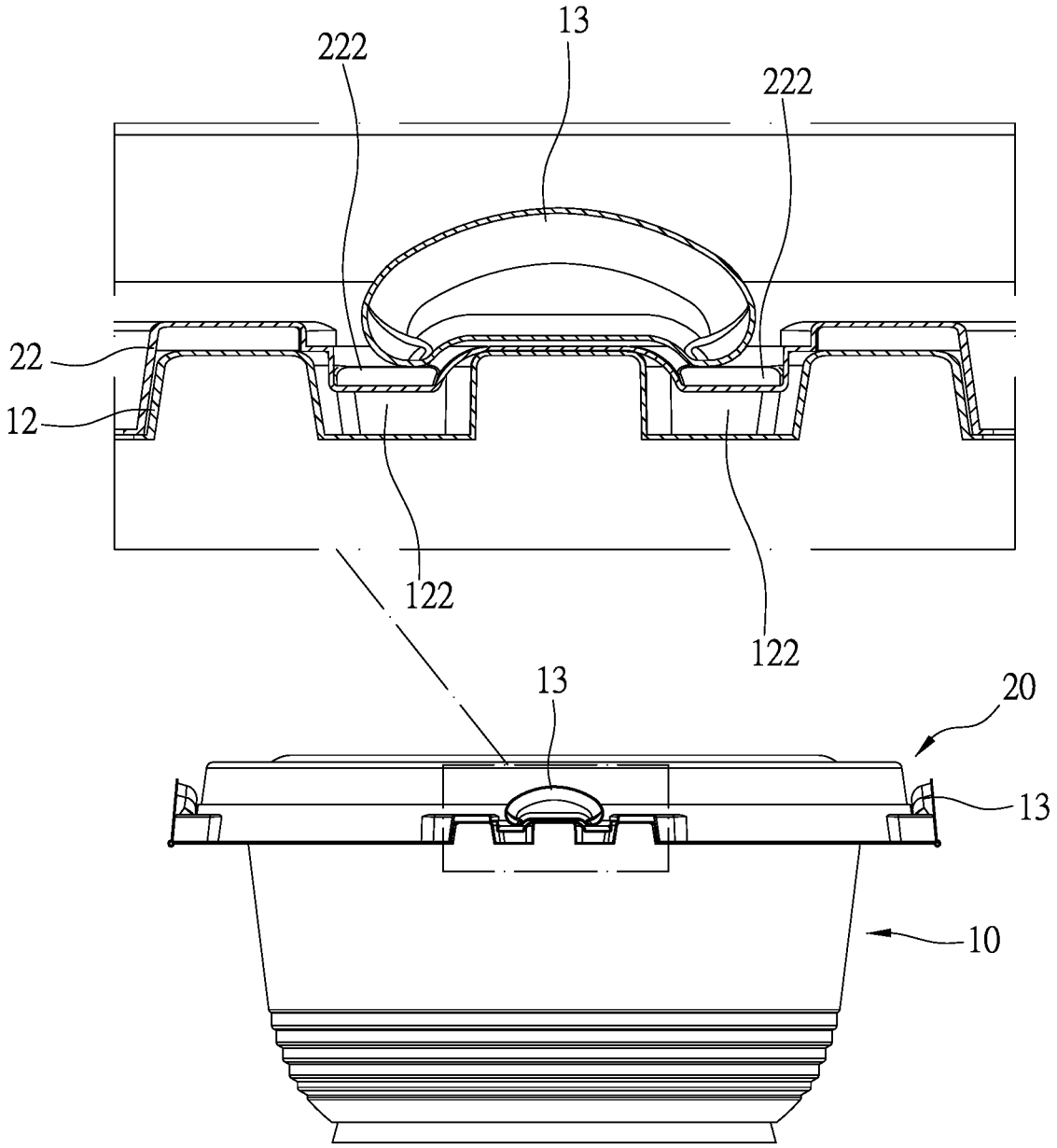
FIG. 8 is another sectional view and a partial enlarged schematic view of the movable securing the covering member of the preferred embodiment according to the present invention.

For the use state of its structure, please refer to FIGS. 5 to 8 again. The covering member 20 covers the outer lip edge 11 around the opening of the containing body 10 with the surrounding covering lip 21, and the protrusion locking portion 22 is aligned to cover the engaging portion 12; thereby the covering member 20 is positioned to cover the opening of the containing body 10, and the locking protrusion 221 of the locking portion 22 covers Outside the engaging protrusion 121 of the engaging portion 12. While the bottom surface of the slot 225 of the locking protrusion 221 is further supported by the top of the engaging protrusion 121, it helps to improve the strength of the locking protrusion 221, then the movable buckle 13 connected to each engaging portion 12 is pushed toward to the covering member 20, and the engaging curve 132 of the movable buckle 13 is secured with the locking protrusion 221 of the locking portion 22. When the buckle is locked, the engaging groove 133 of each engaging curve 132 is engaged with each locking protrusion 221, the engaging ring 135 of the engaging curve 132 reduces the opening range of the engaging groove 133, and the locking 221 is further provided with the securing portion 223 for engaging with the engaging ring 135, therefore the movable buckle 13 needs an external force applied to bring the engaging ring 135 over the securing portion 223 to make the engaging groove 133 to cover the locking protrusion 221, and the engaging ring 135 is limited in the slot 225 to be fastened with the securing portion 223. Also, the contact sides 134 on both sides of the engaging groove 133 abut against the positioning grooves 222 on both sides of the locking protrusion 221, the movable buckle 13 is aligned with the end of the engaging portion 12, so as to increase the tightness of engagement between the movable buckle 132 and the locking protrusion 221 and prevent the covering member 20 from detaching and opening from the containing body 10 when collision occurs, which improves the packing stability of the containing body 10 and the covering member 20. In order to remove the covering member 20 away from the containing body 10, the movable buckle 13 needs to be disengaged from the locking protrusion 221, and the covering member 20 is further removed from the locking protrusion 221. When the containing body 10 is opened, an external force is also required to make the engaging ring 135 go over the securing portion 223 and be released from the engagement. Moreover, with the securing portion 221 and the reinforcing structure 224 on the outer surface of the securing portion 223, the structural strength of the securing portion 223 can still be ensured under the normal reciprocating opening and closing action, thereby helping to prolong the service life of the securing portion 221 and enhancing the willingness of the user to repeatedly use the containing body 10 and the covering member 20, both with environmental benefits.

With the structure of the above-mentioned specific embodiment, the following benefits can be obtained: When the containing body 10 and the covering member 20 are snap-closed, each locking portions 22 of the covering member 20 is positioned correspondingly with each engaging portion 12 of the containing body 10 and makes the covering lip 21 of the covering member 20 covers the outer lip edge 11 of the containing body 10, and then through the movement of the movable buckle 13, each the engaging curve 132 is firmly and tightly buckled onto each locking protrusion 221, so that the covering member 20 is quickly and easily covered and buckled on the periphery of the opening of the containing body 10.

Secondly, when the engaging curve 132 of the movable buckle 13 and the locking ring 221 of the locking portion 22 are engaged together, then with the engagement of the engaging ring 135 of the engaging curve 132 and the securing portion 223 of the locking protrusion 221 together, the bonding strength of the covering member 20 and the containing body 10 is strengthen, which ensures the stability of the covering member 20 in the engagement and prevents the covering member 20 from being detached and opened due to the impact of extrusion.

Although the present invention has been explained in relation to its preferred embodiment, it is to be understood that many other possible modifications and variations can be made without departing from the spirit and scope of invention as hereinafter claimed.

What is claimed is:

1. An engaging structure for a container and its cover comprising: a containing body and a corresponding covering member, wherein:

the containing body has an outer lip edge at an opening of the containing body, the outer lip edge having at least two engaging portions at two opposite positions, each engaging portion having an engaging protrusion at a central position and two engaging recesses respectively on opposite sides of the engaging protrusion; each engaging portion further comprising a movable buckle with an engaging curve at an outer edge, the engaging curve further having an engaging groove with two contact sides facing one of the engaging protrusions and an engaging ring extending from a top end of the engaging curve and parallel to the engaging groove; the covering member has a covering lip covering the outer lip edge of the containing body, the covering lip comprising at least two locking portions correspondingly covering and positioning the engaging portions of the containing body; each locking portion comprising a locking protrusion with two opposing positioning grooves, the locking protrusion being hollow and correspondingly capable of covering one of the engaging protrusions, and the two positioning grooves interlock with the two engaging recesses; the locking protrusion further comprising a securing portion extending from a top, and a slot defined between the securing portion and the covering lip.

2. The engaging structure for a container and its cover as claimed in claim 1, wherein the containing body comprises four engaging portions on the outer lip edge, and the covering member has four locking portions on the covering lip.

3. The engaging structure for a container and its cover as claimed in claim 1, wherein a flexible portion is disposed between each movable buckle and each engaging portion, which allows the movable buckle to be bent towards the outer lip edge.

4. The engaging structure for a container and its cover as claimed in claim 1, wherein each engaging curve has an incline surface and the two contact sides are inclined.

5. The engaging structure for a container and its cover as claimed in claim 1, wherein each positioning groove has an inclined surface.

6. The engaging structure for a container and its cover as claimed in claim 1, wherein each locking protrusion and each securing portion respectively have a plurality of reinforcement structures.

7. The engaging structure for a container and its cover as claimed in claim 1, wherein the covering lip of the covering member further comprises a flippable wing.

* * * * *